US007575478B1

(12) United States Patent
Wei

(10) Patent No.: US 7,575,478 B1
(45) Date of Patent: Aug. 18, 2009

(54) HIGH FREQUENCY CONNECTOR HAVING COMMON MODE CHOKE COIL

(75) Inventor: Kuan-Hsiung Wei, Taoyuan Hsien (TW)

(73) Assignee: Speed Tech Corp., Taoyuan Hsien (TW)

( * ) Notice: Subject to any disclaimer, the term of this patent is extended or adjusted under 35 U.S.C. 154(b) by 23 days.

(21) Appl. No.: 12/049,387

(22) Filed: Mar. 17, 2008

(51) Int. Cl.
*H01R 13/66* (2006.01)

(52) U.S. Cl. ..... 439/620.11

(58) Field of Classification Search ..... 439/620.11, 439/620.12, 620.13, 620.1
See application file for complete search history.

(56) References Cited

U.S. PATENT DOCUMENTS 6,554,638 B1 * 4/2003 Hess et al. ..... 439/490
7,153,163 B2 12/2006 Lewis et al.
7,458,856 B2 * 12/2008 Ferentz ..... 439/620.23

* cited by examiner

*Primary Examiner*—Neil Abrams
(74) *Attorney, Agent, or Firm*—Jianq Chyun IP Office

(57) ABSTRACT

A high frequency connector having a CMC is provided. The high frequency connector includes an insulating housing, a plurality of interconnection terminals and a plurality of transmitting terminals. The insulating housing includes an interconnection slot for receiving a part of the interconnection electronic apparatus inserted therein. The insulating housing includes a circuit board receiving slot, which is adapted for fixing the circuit board in the high frequency connector. The interconnection terminals are respectively fixed at the insulating housing. The interconnection terminals extend through the interconnection slot and the circuit board receiving slot of the insulating housing, so as to electrically connect the interconnection slot and a circuitry of the circuit board. The circuitry at least includes a CMC having at least one grounded central tapped wire.

8 Claims, 9 Drawing Sheets

HIGH FREQUENCY CONNECTOR HAVING COMMON MODE CHOKE COIL

BACKGROUND OF THE INVENTION

1. Field of the Invention

The present invention generally relates to a high frequency connector having a common mode choke coil (CMC), and more particularly, to a high frequency connector having a CMC equipped therein for filtering a common mode noise.

2. Description of Related Art

Currently, a typical high frequency Ethernet may achieve a transmission speed up to 1000M bps or 1 Giga bps. Such high frequency signals are very sensitive to electro-magnetic interference (EMI), and cross talks are very likely to occur among a multiple high frequency signals. Unshielded twisted pair (UTP) cables are relative cheap and usually adopted as transmission media for connecting or transmitting a high frequency Ethernet. Such a UTP cable structurally differs from those expansive coaxial cables which are often used for transmitting high frequency signals in that the UTP cable does not have a metal shielding layer. Therefore, when a high frequency signal is transmitted along the UTP cable, the UTP cable is incapable of providing an effective EMI shield and thus the high frequency signal transmitted in the UTP cable is very likely to interfere with other electronic apparatus and cause noises thereby.

However, there is no effective and economic solution provided for completely overcoming the disadvantage of the UTP cable. As such, noises of the UTP cable is usually dealt by signal conditioning. As well known, the high frequency Ethernet transmits differential mode signals with a differential mode. Unfortunately, a common mode signal occurred in the UTP cable often interferes other electronic apparatuses. Such a common mode signal is also known as a common mode noise. Correspondingly, a conventional Ethernet signal conditioning method introduces a common mode choke coil (CMC) in a high frequency connector of an end of the UTP cable. This CMC is adapted to attenuate energy of the common mode signal.

U.S. Pat. No. 7,153,163 discloses a modular jack for Ethernet application, in which a CMC is directly equipped to a high frequency connector. As shown in FIG. 1, there are shown eight signal terminals RJ-1, RJ-2, RJ-3, RJ-4, RJ-5, RJ-6, RJ-7, and RJ-8 of the high frequency connector of U.S. Pat. No. 7,153,163 respectively coupled to four CMCs, CMC1, CMC2, CMC3 and CMC4 for filtering away common mode noises from four sets of differential mode signals transmitted by an input terminal of the high frequency connector.

FIG. 2A is a schematic diagram illustrating an electromagnetic filed applied by a set of differential mode signals on a conventional CMC. Referring to FIG. 2A, an ordinary CMC typically includes a pair of wires L1 and L2 wounded on an iron core F. The pair of wires L1 and L2 is adapted for transmitting a set of common mode signals or differential mode signals. Supposing a set of differential mode signals are transmitted by the wires L1 and L2 via CMC1, a current I1 is defined as being transmitted from a node N11 of the wire L1 to another node N12 of the wire L1 via CMC1, and another current I2 is defined as being transmitted from a node N22 of the wire L2 to another node N21 of the wire L2 via CMC1. In this case, the wires L1 and L2 generate electromagnetic fields Ed1, Ed2 respectively. The electromagnetic fields Ed1, Ed2 are opposite in direction and can be substantially counteracted one by another. In such a way, differential mode signals transmitted by the wires L1 and L2 have almost no variation in resistance when flowing through CMC1. As such, there is almost no attenuation of an energy transmitted from the wire L1 to the wire L2 when flowing through CMC1.

FIG. 2B is a schematic diagram illustrating an electromagnetic filed applied by a set of common mode signals on a conventional CMC. Referring to FIG. 2B, supposing 11 and 12 are a set of common mode signals transmitted by the wires L1 and L2 via CMC1. The current I2 is considered as a being transmitted from the node N21 of the wire L2 to another node N22 of the wire L2 via CMC1, in which electromagnetic fields Ec1, Ec2 generated by the wires L1 and L2 are identical in direction. In such a way, the electromagnetic field generated by the wires L1 and L2 at the iron core F is a sum of the electromagnetic files of Ec1 and Ec2. In such a way, the common mode signals transmitted by the wires L1 and L2 cause apparent variation in resistance when flowing through CMC1. As such, energy of the common mode signals in the wires L1 and L2 is converted into heat and radiation and attenuated thereby due to return loss. Therefore, the energy of the common mode signal drastically attenuates when flowing through CMC1.

In summary, when flowing through the CMC1, a common mode signal causes an energy radiation. Therefore, when such a CMC1 is equipped into a high frequency connector, the CMC1 becomes a radiation source, because there is a set of common mode signals flowing through the CMC1. Accordingly, the differential mode signals flowing through the CMC1 unfortunately suffer EMI. This usually occurs in high frequency connectors having metal shields, in which the radiation of the radiation source is restricted within a range of a shielding housing.

SUMMARY OF THE INVENTION

Accordingly, the present invention is directed to a high frequency connector having a CMC. The present invention is also directed to a CMC which is small enough to be installed within a high frequency connector.

The present invention is also directed to a high frequency connector having a CMC which is capable of depressing a generation of a radiation.

The present invention is also directed to a center tapped line which is grounded. When the common mode signal flows through the CMC, the radiation generated by the common mode signals can be guided to the ground by the center tapped line.

According to an embodiment of the present invention, the CMC according to the present invention is configured at a circuit board so as to be equipped in a high frequency connector. The high frequency connector includes an insulating housing, a plurality of interconnection terminals and a plurality of transmitting terminals. The insulating housing includes an interconnection slot for receiving a portion of the interconnection electronic apparatus inserted therein. The insulating housing includes a circuit board receiving slot, which is adapted for fixing the circuit board in the high frequency connector. The interconnection terminals are respectively fixed at the insulating housing. The interconnection terminals extend through the interconnection slot and the circuit board receiving slot of the insulating housing, so as to electrically connect to the interconnection electronic apparatus in the interconnection slot and a circuitry of the circuit board. The electronic circuitry at least includes a CMC having at least one grounded central tapped wire. The transmitting terminals electrically couple the electronic circuitry of the circuit board with a main board.

According to an embodiment of the present invention, the interconnection terminal transmits the signals transmitted by the interconnection electronic apparatus to the circuitry. After flowing through the CMC in the electronic circuitry, the signals are transmitted to circuitries other than the high frequency connector via the transmitting terminals. If the signals are differential mode signals, such signals flowing through the CMC almost cause no variation of electromagnetic field and resistance thereof. Therefore, the differential mode signals won't be attenuated. If the signals are common mode signals, such signals flowing through the CMC cause apparent variation of electromagnetic field which further causes a drastic variation of the resistance of the CMC. Accordingly, the energy of the common mode signals is converted into heat and radiation. The radiation can thus be guided or bypassed to the ground by the grounded center tapped line introduced to the CMC.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
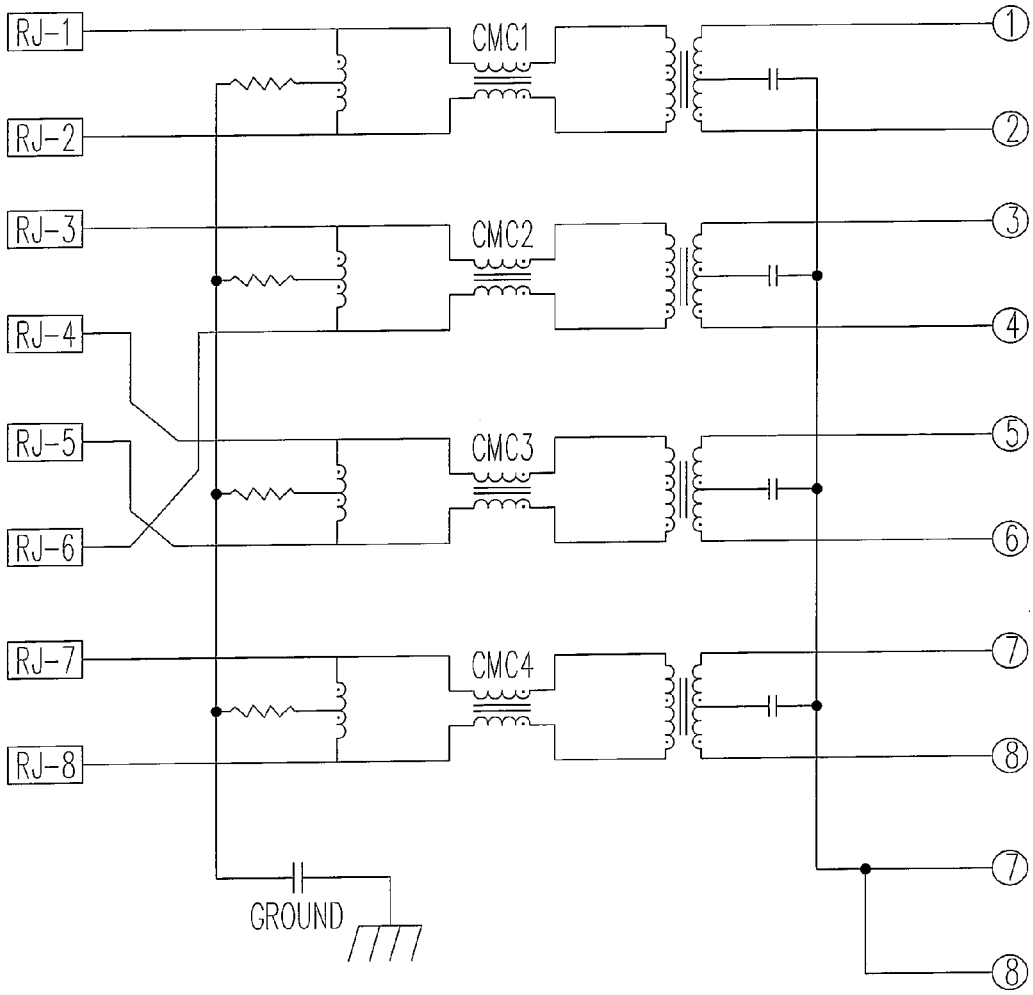
FIG. 1 (PRIOR ART)
FIG. 1 is a schematic diagram illustrating a circuitry disclosed by U.S. Pat. No. 7,153,163.
Figure 2A:
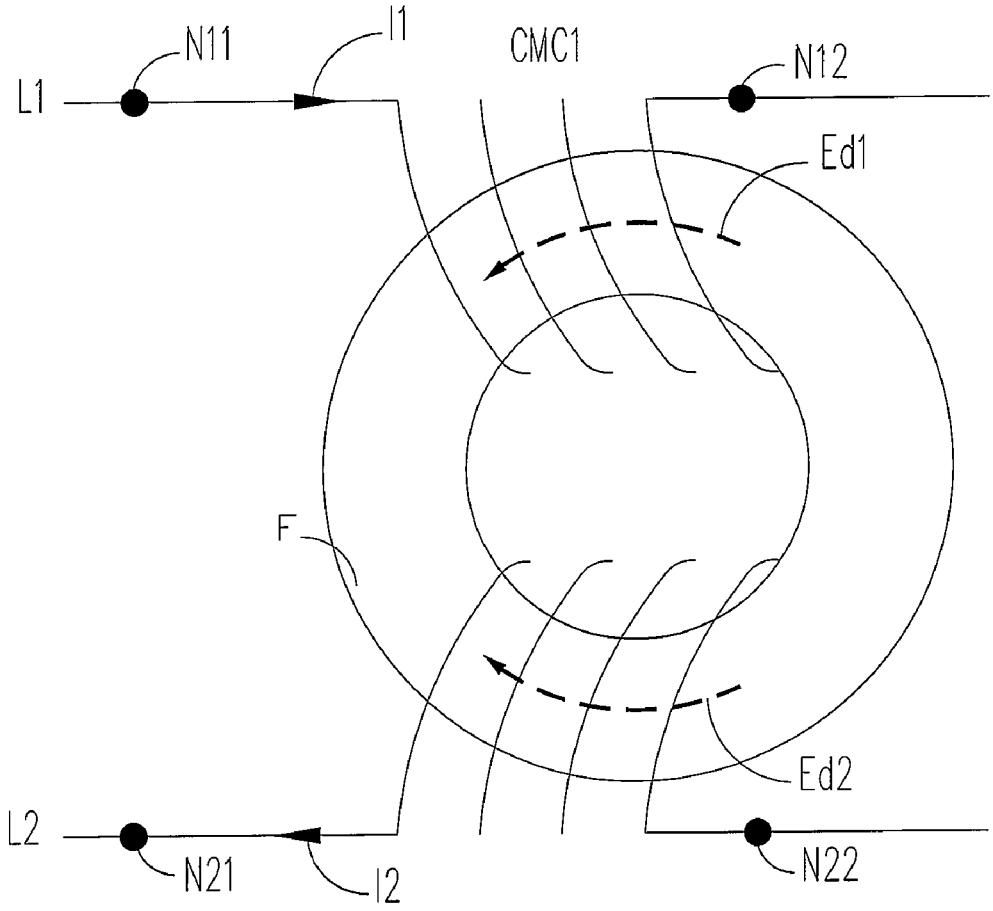
FIG. 2A (PRIOR ART)
FIG. 2A is a schematic diagram illustrating an electromagnetic filed applied by a set of differential mode signals on a conventional CMC.
Figure 2B:
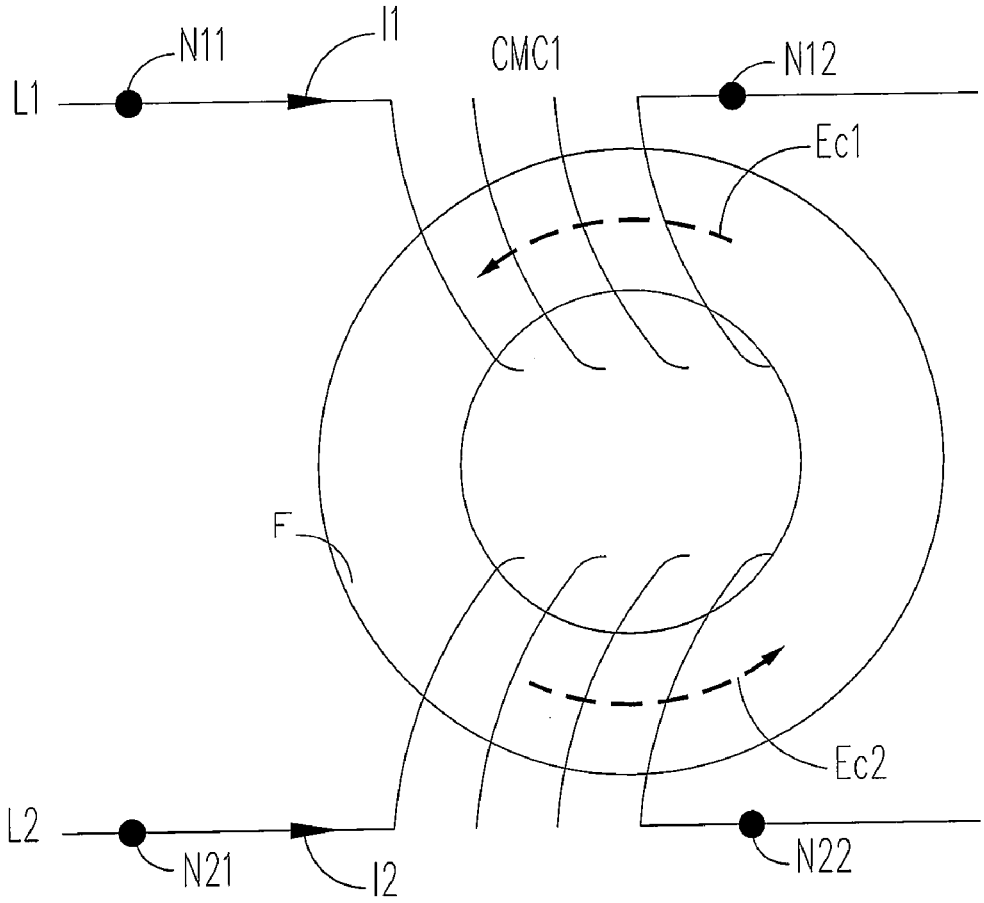
FIG. 2B (PRIOR ART)
FIG. 2B is a schematic diagram illustrating an electromagnetic filed applied by a set of common mode signals on a conventional CMC.

Reference will now be made in detail to the present preferred embodiments of the invention, examples of which are illustrated in the accompanying drawings. Wherever possible, the same reference numbers are used in the drawings and the description to refer to the same or like parts.

Figure 3A:
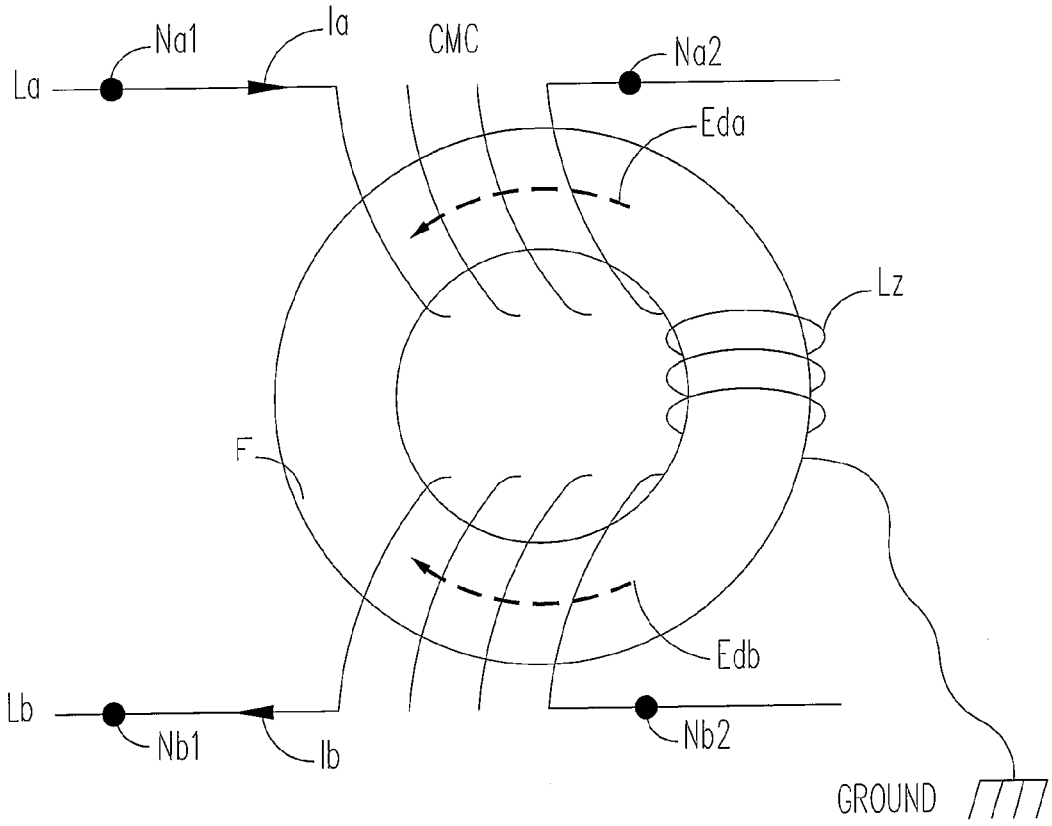
FIG. 3A is a schematic diagram illustrating an electromagnetic filed applied by a set of differential mode signals on a CMC according to an embodiment of the present invention.

FIG. 3A is a schematic diagram illustrating an electromagnetic filed applied by a set of differential mode signals on a CMC according to an embodiment of the present invention. Referring to FIG. 3A, the CMC according to an embodiment of the present invention includes a pair of signals lines La and Lb wound on an iron core F, and a center tapped line Lz wound on the iron core F. The center tapped line Lz is grounded. When a set of differential mode signals are transmitted through the CMC according to the embodiment of the present invention, a current Ia is defined as flowing from a node Na1 of the signal line La to another node Na2 of the signal line La via the CMC, and another current Ib is defined as flowing from a node Nb2 of the signal line Lb to another node Nb1 of the signal line Lb via the CMC. There exists a phase difference of 180° between currents flowing through the signals lines La and Lb. Therefore, differential mode signals being transmitted through signal lines La and Lb generate electromagnetic fields Eda, Edb, respectively. The electromagnetic fields Eda, Edb are opposite in direction and can be substantially counteracted one by another. In such a way, differential mode signals transmitted by the signal lines La and Lb have almost no variation in resistance when flowing through CMC.

Figure 3B:
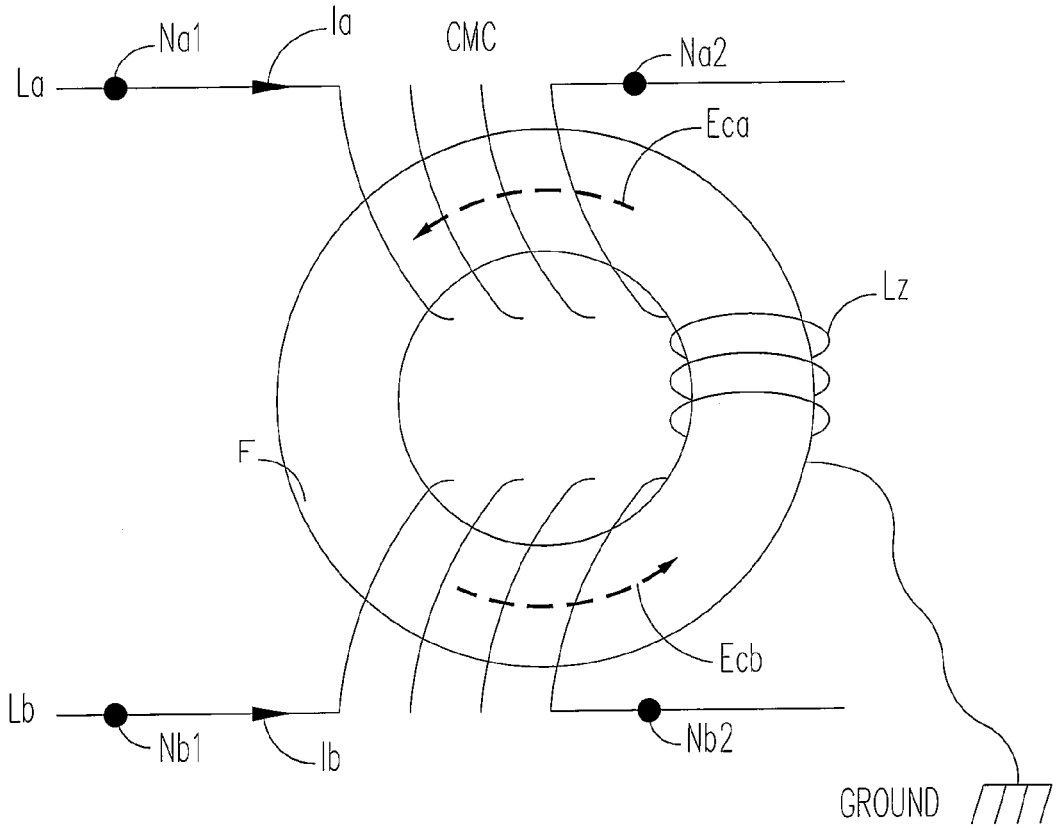
FIG. 3B is a schematic diagram illustrating an electromagnetic filed applied by a set of common mode signals on a CMC according to an embodiment of the present invention.

FIG. 3B is a schematic diagram illustrating an electromagnetic filed applied by a set of common mode signals on a CMC according to an embodiment of the present invention. Referring to FIG. 3B, when a set of common mode signals are transmitted through the CMC according to the embodiment of the present invention, the current Ia is defined as flowing from a node Na1 of the signal line La to another node Na2 of the signal line La via the CMC, and another current Ib is defined as flowing from the node Nb1 of the signal Lb to the node Nb2 of the signal line Lb via the CMC. There exists no phase difference between currents flowing through the signals lines La and Lb. Therefore, common mode signals being transmitted through the signal lines La and Lb generate electromagnetic fields Eca, Ecb, which are identical in direction. Therefore, the electromagnetic fields Eca, Ecb generated by the two signal lines La and Lb are summed, and an enlarged electromagnetic field applied on the CMC occurs. Such an enlarged electromagnetic field apparently varies a resistance value of the CMC corresponding to the common mode signals flowing therethrough, and causes an apparent attenuation of energy of the common mode signals flowing therethrough.

When the energy of the common mode signals flowing through the CMC attenuates, the attenuated energy is converted into heat and radiation due to the return loss caused by the resistance variation. The radiation are then guided and dissipated to the ground via the grounded center tapped line Lz which is wound on the iron core F.

It should be noted that the drawings according to the embodiments of the present invention are schematic and for illustration purpose only. There are shown schematic or simplified winding method of the CMC. It is well known that any variation or modification of the signals lines wound on the iron core may cause changes in electronic characteristics of the CMC, and the present invention shall not be construed as being restricted as shown in the schematic drawings.

Figure 4A:
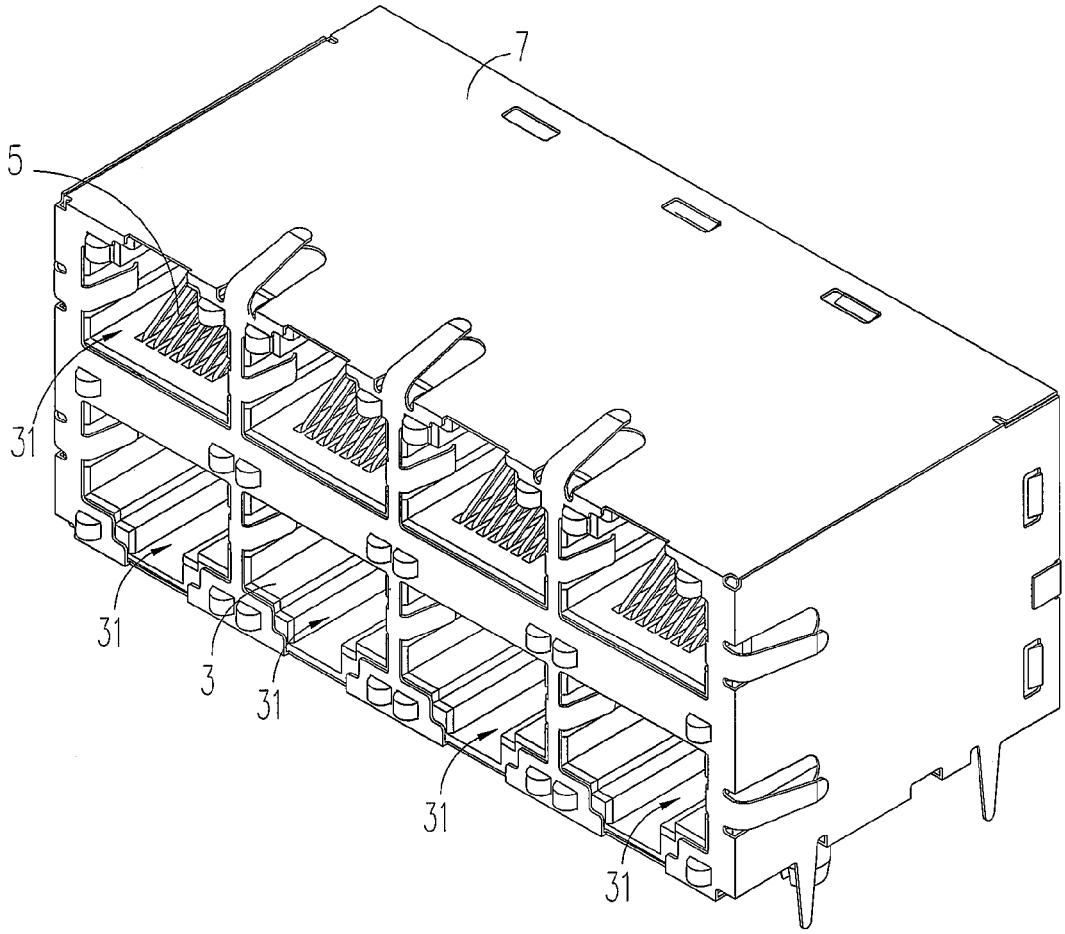
FIG. 4A is a structural schematic structural diagram illustrating a dual layer Ethernet high frequency connector equipped with the CMC shown in FIGS. 3A and 3B.
Figure 4B:
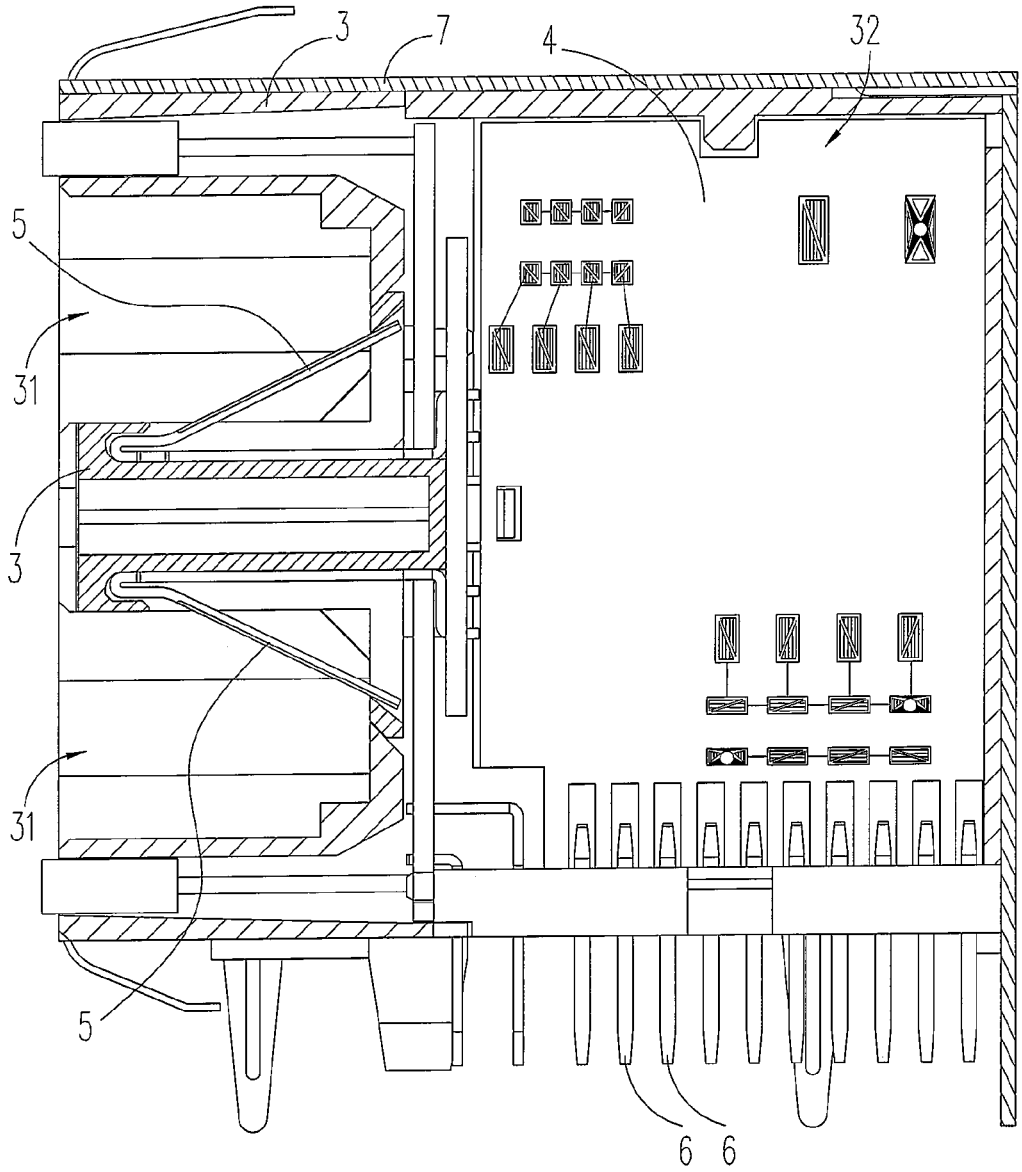
FIG. 4B is a cross-sectional view of FIG. 4A.

FIG. 4A is a structural schematic structural diagram illustrating a dual layer Ethernet high frequency connector equipped with the CMC of FIGS. 3A and 3B. FIG. 4B is a cross-sectional view of FIG. 4A. Referring to FIGS. 4A and 4B, there is shown an Ethernet high frequency connector. The Ethernet high frequency connector is an eight-port Ethernet high frequency connector having its eight ports distributed in two layers (an upper layer and a bottom layer), having a right side and a left side each including four ports. According to an aspect of the embodiment, each of the eight ports of the eight-port Ethernet high frequency connector can be considered as a high frequency connector. Accordingly, those skilled in the art may be taught to apply the present invention into a single port high frequency connector, e.g., an RJ-45 connector.

According to an embodiment of the present invention, the Ethernet high frequency connector includes an insulating housing 3, a circuit board 4, a plurality of interconnection terminals 5, and a plurality of transmitting terminals 6. An electronic circuitry having the CMC of FIGS. 3A and 3B is disposed in the circuit board 4. The insulating housing 3 includes an interconnection slot 31 and a circuit receiving slot 32. The interconnection slot 31 is adapted for receiving a part of an interconnection electronic apparatus, so as to allow at least a part of interconnection electronic apparatus to be inserted in the interconnection slot 31. The circuit receiving slot 32 is adapted for receiving the circuit board 4. The interconnection terminals 5 are fixed on the insulating housing 3. Each of the interconnection terminals 5 extends through the interconnection slot 31 and the circuit receiving slot 32 of the insulating housing 3 and is electrically connected to the circuit board 4. As such, when the interconnection electronic apparatus is inserted into the interconnection slot 31 of the insulating housing 3, the interconnection electronic apparatus can be electrically connected to the circuit board 4 via the interconnection terminals 5. The transmitting terminals 6 are adapted for electrically connecting the circuit board 4 to circuitries other than the high frequency connector, e.g., a circuitry on a main board (not shown in the drawings).

According to an embodiment of the present invention, besides the CMC, the circuit board 4 may further include other electronic components, such as isolation transformers, LC filters, or the like. The isolation transformers can be used for adjusting the resistance of the circuitry, and the LC filters can be used for filtering the high frequency noise.

According to an aspect of the embodiment of the present invention, the insulating housing 3 further includes a metal shielding casing 7 disposed at an outside of the insulating housing 3 for preventing external EMI signals from transmitting into the high frequency connector. According to another aspect of the embodiment, the metal shielding casing 7 is electrically connected to a grounding circuit of the main board, and the center tapped line Lz of the CMC is grounded via the metal shielding casing 7 of the high frequency connector. Preferably, the center tapped line Lz of the CMC is clamped by the metal shielding casing 7, or alternatively soldered to the metal shielding casing 7.

Figure 5:
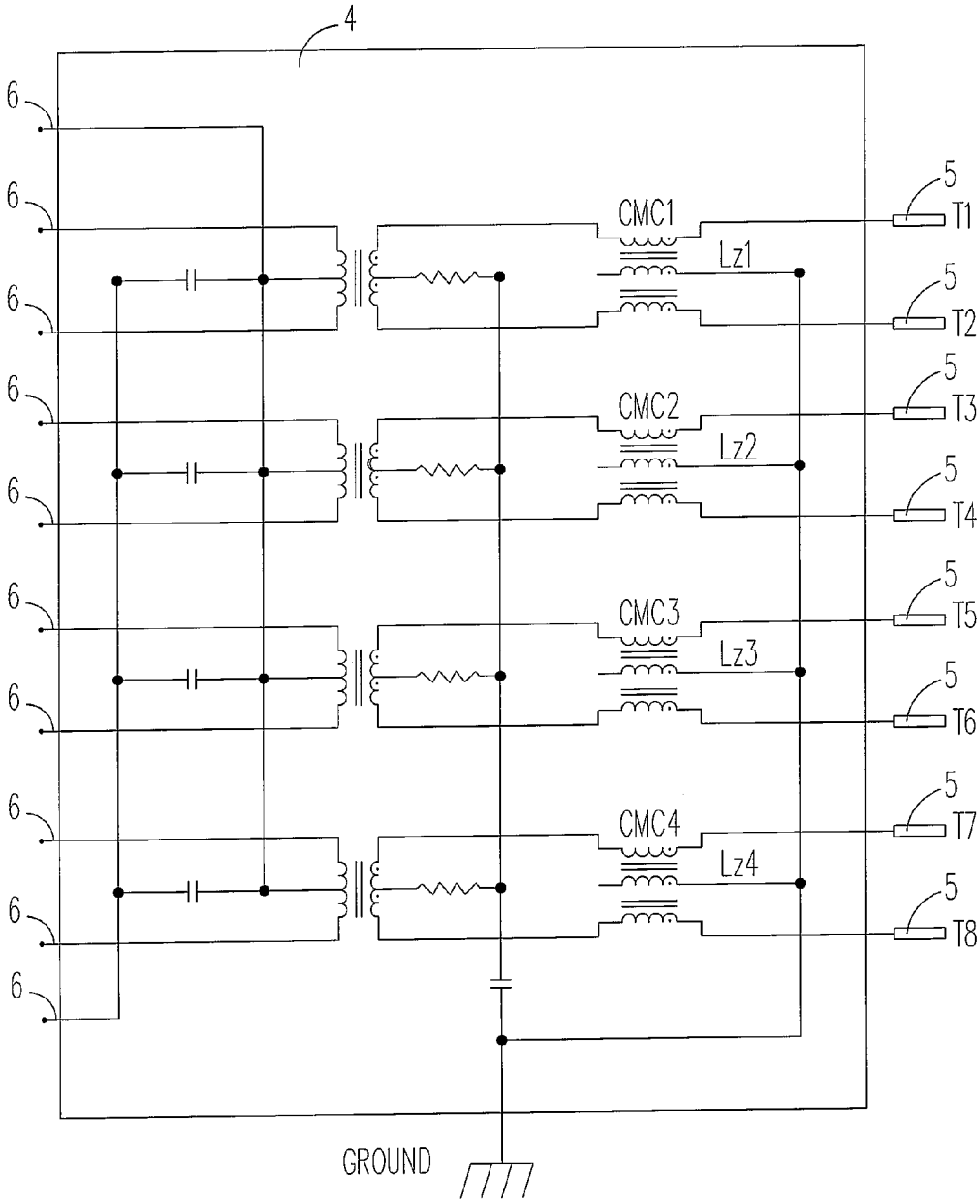
FIG. 5 is a schematic diagram illustrating a circuitry for the high frequency connector according to an embodiment of the present invention.

FIG. 5 is a schematic diagram illustrating a circuitry for the high frequency connector according to an embodiment of the present invention. Referring to FIG. 5, when the CMC according to the present invention is applied to a conventional Ethernet high frequency connector, the current flows from four pairs of interconnection terminals 5 (numbered from T1 to T8) to the internal circuit board 4. In an ideal situation, the four pairs of interconnection terminals 5 are preferred to transmit four sets of differential mode signals. Unfortunately, being affected by EMI, the four sets of differential mode signals may be mixed with certain common mode signal noises. In the current embodiment, the four sets of differential mode signals having certain common mode signal noises mixed therewith first flow through four CMCs, CMC1, CMC2, CMC3, and CMC4, respectively, for removing the mixed common mode signal noises from the four sets of differential mode signals. And thereafter the four sets of differential mode signals are transmitted to the main board through transmitting terminals 6.

According to an embodiment of the present invention, each of the CMCs has a grounded center tapped line Lz1, Lz2, Lz3, and Lz4, respectively. In such a way, EMI generated by the CMCs, CMC1, CMC2, CMC3, and CMC4, are guided or bypassed by the grounded center tapped line Lz1, Lz2, Lz3, and Lz4 to the ground, and so as to depress the generation of EMI at the CMCs of the Ethernet high frequency connector, and thus improving the capability of EMI prevention.

Figure 6:
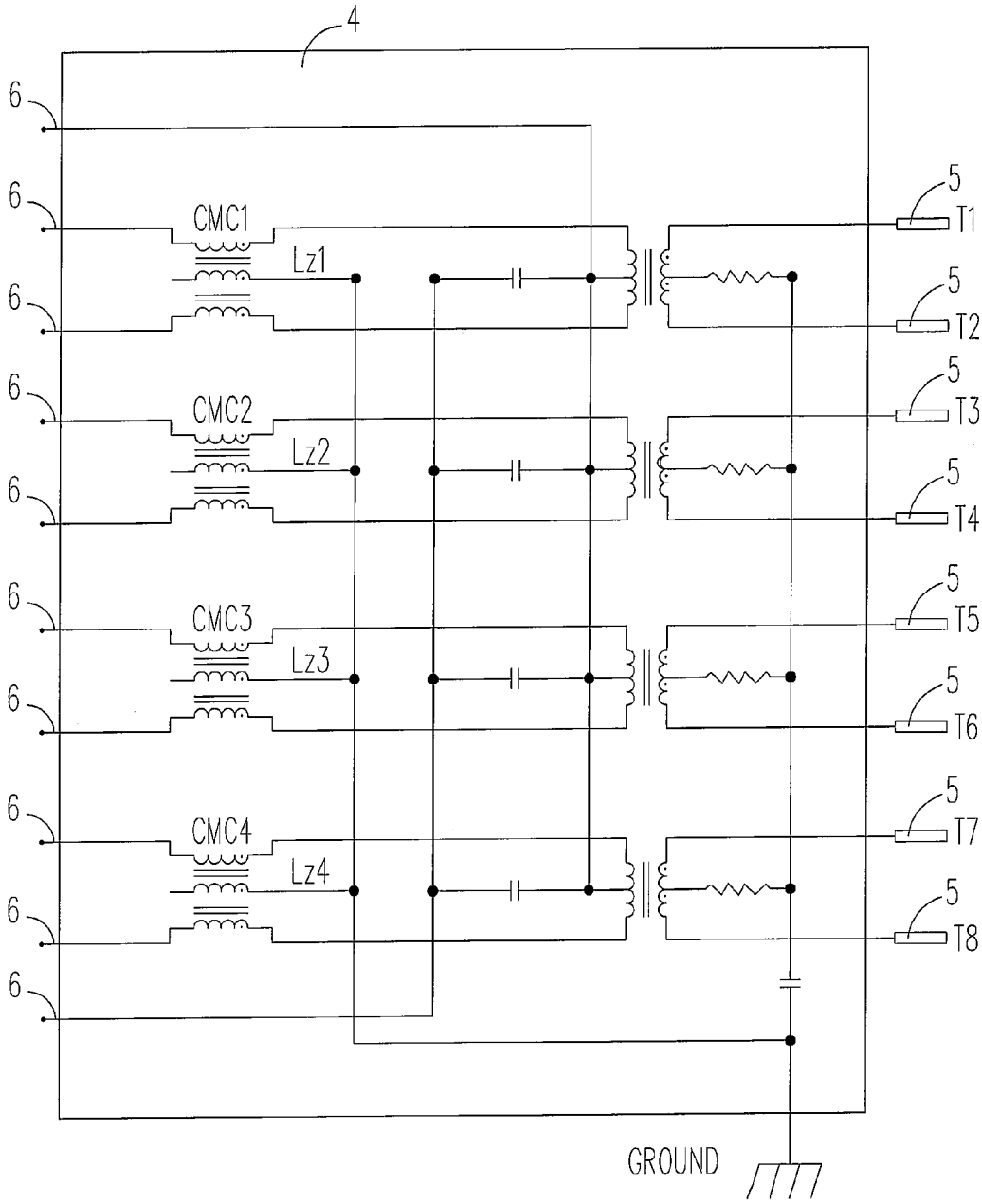
FIG. 6 is a schematic diagram illustrating a circuitry for the high frequency connector according to another embodiment of the present invention.

FIG. 6 is a schematic diagram illustrating a circuitry for the high frequency connector according to another embodiment of the present invention. According to the current embodiment, the signals need not flow through the CMCs, CMC1, CMC2, CMC3, and CMC4, first. In the current embodiment, the CMCs, CMC1, CMC2, CMC3, and CMC4, are disposed adjacent to an output terminal of the circuit board 4 which is adjacent to the transmitting terminals 6. Because each of the CMCs, CMC1, CMC2, CMC3, and CMC4, has a center tapped line Lz1, Lz2, Lz3, and Lz4, grounded respectively. The EMI generated by each of the CMCs, CMC1, CMC2, CMC3, and CMC4 is also guided and dissipated to the ground.

In summary, the present invention proposes to ground the CMCs, CMC1, CMC2, CMC3, and CMC4, respectively, so as to guide EMI generated by the CMCs, CMC1, CMC2, CMC3, and CMC4 to the ground without restricting any approaches in electrically connecting the center tapped lines Lz1, Lz2, Lz3, and Lz4 of the CMCs, CMC1, CMC2, CMC3, and CMC4. According to an aspect of the embodiment, the four center tapped lines Lz1, Lz2, Lz3, and Lz4 of the CMCs, CMC1, CMC2, CMC3, and CMC4 are soldered to or clamped by the metal shielding casing 7, so as to ground the CMCs, CMC1, CMC2, CMC3, and CMC4 by the center tapped lines Lz1, Lz2, Lz3, and Lz4.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A high frequency connector, comprising:

an electronic circuitry, having a common mode choke coil (CMC), wherein the CMC comprises at least one grounded center tapped line;

an insulating housing, comprising:

an interconnection slot for receiving a portion of an interconnection electronic apparatus;

a circuit receiving slot, for receiving the electronic circuitry;

a plurality of interconnection terminals, fixed to the insulating housing for electrically connecting the interconnection electronic apparatus and the electronic circuitry; and a plurality of transmitting terminals, for electrically connecting the electronic circuitry and external circuitries of the high frequency connector.

2. The high frequency connector according to claim 1, wherein the electronic circuitry comprises a plurality of CMCs, and each of the CMCs is grounded via a same center tapped line.

3. The high frequency connector according to claim 2, wherein the electronic circuitry further comprises a plurality of transformers, and the interconnection terminals are respectively connected to corresponding transformers and corresponding CMCs.

4. The high frequency connector according to claim 3, wherein currents corresponding to the interconnection terminals flow through the corresponding CMCs first and are then transmitted to the corresponding transformers.

5. The high frequency connector according to claim 3, wherein currents corresponding to the interconnection terminals flow through the corresponding transformers first and are then transmitted to the corresponding CMCs.

6. The high frequency connector according to claim 1, wherein the center tapped lines are electrically connected to a circuitry other than the high frequency connector.

7. The high frequency connector according to claim 1, wherein the insulating housing further comprises a metal shielding casing disposed at an outside of the insulating housing.

8. The high frequency connector according to claim 7, wherein the center tapped line is electrically connected to the metal shielding casing of the high frequency connector.

* * * * *